US007017988B2

(12) United States Patent
Tornero et al.

(10) Patent No.: US 7,017,988 B2
(45) Date of Patent: Mar. 28, 2006

(54) RETRACTABLE WORK SURFACE FOR A CHAIR

(75) Inventors: Marta Tornero, Greensboro, NC (US); LeRoy Johnson, Lowell, MI (US)

(73) Assignee: L & P Property Management Company, South Gate, CA (US)

( * ) Notice: Subject to any disclaimer, the term of this patent is extended or adjusted under 35 U.S.C. 154(b) by 46 days.

(21) Appl. No.: 10/417,561

(22) Filed: Apr. 17, 2003

(65) Prior Publication Data

US 2004/0207238 A1 Oct. 21, 2004

(51) Int. Cl.
*A47B 39/00* (2006.01)

(52) U.S. Cl. ..... 297/145; 297/155; 297/173; 297/188.14

(58) Field of Classification Search ..... 297/145, 297/155, 173, 188.14, 188.15, 188.21, DIG. 4, 297/42, 423.37, 423.26; 108/42, 152
See application file for complete search history.

(56) References Cited

U.S. PATENT DOCUMENTS

| | | | | |
|---|---|---|---|---|
| 151,687 | A | 6/1874 | Durrie | |
| 1,217,231 | A * | 2/1917 | Soper | 297/145 |
| 2,034,835 | A * | 3/1936 | Rubino | 297/161 |
| 2,628,666 | A * | 2/1953 | Hall | 297/174 R |
| 3,556,588 | A * | 1/1971 | Monyer et al. | 297/162 |
| 4,203,624 | A | 5/1980 | Hopkins | |
| 4,662,676 | A | 5/1987 | Havelock | |
| 5,087,096 | A * | 2/1992 | Yamazaki | 297/145 |
| 5,222,783 | A * | 6/1993 | Lai | 297/301.4 |
| 5,490,710 | A | 2/1996 | Dearing et al. | |
| 5,573,301 | A * | 11/1996 | Scott | 297/173 |
| 5,612,718 | A | 3/1997 | Bryan | |
| 5,683,136 | A * | 11/1997 | Baumann et al. | 297/162 |
| 5,799,964 | A * | 9/1998 | Chao | 280/304.1 |
| D403,312 | S | 12/1998 | O'Brien et al. | |
| 5,865,124 | A * | 2/1999 | Wroe | 108/26 |
| 5,899,526 | A * | 5/1999 | LaPointe et al. | 297/173 |
| 5,909,864 | A * | 6/1999 | Wang | 248/289.11 |
| 5,931,102 | A * | 8/1999 | Grahl | 108/42 |
| 5,931,528 | A | 8/1999 | Shields | |
| 6,073,997 | A * | 6/2000 | Koh | 297/173 |
| 6,123,387 | A | 9/2000 | Kelly | |
| 6,142,559 | A * | 11/2000 | Sorel et al. | 297/135 |
| 6,179,263 | B1 * | 1/2001 | Rosen et al. | 248/278.1 |
| 6,375,257 | B1 * | 4/2002 | Wooding et al. | 297/162 |
| 6,702,373 | B1 * | 3/2004 | Rossko | 297/173 |

FOREIGN PATENT DOCUMENTS

| | | | |
|---|---|---|---|
| CA | 2165504 A | * | 7/1996 |
| GB | 2152810 A | * | 8/1985 |

* cited by examiner

*Primary Examiner*—Rodney B. White
*Assistant Examiner*—Stephen D'Adamo
(74) *Attorney, Agent, or Firm*—Shook, Hardy & Bacon LLP

(57) ABSTRACT

A retractable work surface for a chair is provided for a chair that has a pair of arms. The work surface has a removable plate that can be coupled to one of the chair arms or the other. An L-shaped rod is coupled on one end to the plate so that is can rotate with respect to the plate. The other end of the rod has a bracket on one side and a tray on the other side. The bracket and tray can rotate as a unit with respect to the rod. The work surface is easily moved from one arm to the other by removing the plate from one arm and moving it to the other, and by reversing the rod and bracket. The work surface can also easily be retrofit to existing chairs by simply mounting the plate to one of the chair arms.

15 Claims, 4 Drawing Sheets

RETRACTABLE WORK SURFACE FOR A CHAIR

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention relates to a retractable work surface for a chair, and more particularly to a retractable work surface that moves between a horizontal, working position and a vertical, stowed position.

It is often necessary or desirable to work with a laptop computer, documents, mouse, or other items while seated at home or in the office. A user can, of course, move his or her chair to a position adjacent a conventional desk and place the computer or documents on the desk. Lap desks or trays that simply rest on the user's lap are also sometimes used. Conventional desks and lap desks or trays, however, are cumbersome, conspicuous, and inconvenient, and the chair and desk must be stored separately. In addition, a laptop computer placed on a lap desk or tray generates heat that can make prolonged use of the lap desk or tray uncomfortable.

It is also desirable to have a chair with a work surface or mousing surface which can be used by either a right or left handed person. Conventional chairs with work surfaces are traditionally only capable for use by either a right or left handed person. Conventional chairs with work surfaces are also not convertible for right or left hand use.

There are many chairs already in use that have support armrests extending adjacent the seat. These existing armrests do not usually have an associated work surface. It would be desirable to provide these chair owners an opportunity to retrofit their existing chairs with a retractable work surface.

The concept of an office chair with a retractable work surface is known in the art. There is a need however for a chair with a retractable work surface which is easily converted for use by a right or left handed user. There is also a need for a work surface which is easily retrofitted to any existing chair.

BRIEF SUMMARY OF THE INVENTION

Accordingly, it is the object of the present invention to provide a chair with a movable work surface that rotates between a horizontal, working position and a vertical stowed position.

It is a further object of the present invention to provide a tablet arm with a work surface that is easily converted for either a right or left handed user.

Another object of the present invention is to provide a tablet arm with a work surface that is easily retrofitted to an existing chair.

An additional object of the present invention is to provide a grooved stop system which restricts the range of motion of the work surface.

Accordingly, the present invention provides a horizontal work surface for a chair that rotates between a horizontal, working position and a vertical stowed position. The work surface, a tray assembly, is coupled with a grooved bracket and an L-shaped arm. The L-shaped arm is then coupled to a collared plate which can be attached to the arm on a chair. A user wishing to use the work surface sits on the chair and grasps the tray while in the vertical position, extends the tray forward, thus rotating a portion of the L-shaped arm inside the collared plate. The tray assembly is then rotated inward about the L-shaped arm and grooved bracket. The work surface may be retracted by reversing the steps described above. The device of the present invention may also be converted for use by either a right or left handed user by moving the work surface assembly from one arm of the chair to the other.

The device of the present invention may be formed as an integral part of a new chair or may be easily retrofitted to the arm of an existing chair. The device may be retrofitted to an existing chair by modifying the collared plate in a manner that makes it easy to mate with an arm of an existing chair. This can be accomplished by providing a number of slots, holes or grooves that allow the collared plate to be easily attached to the arm of an existing chair.

Additional objects, advantages, and novel features of the invention will be set forth in part in the description which follows, and in part will become apparent to those skilled in the art upon examination of the following, or may be learned by practice of the invention.

BRIEF DESCRIPTION OF THE SEVERAL VIEWS OF THE DRAWING

In the accompanying drawings which form a part of the specification and which are to be read in conjunction therewith, and in which like reference numerals are used to indicate like parts in the various views.

DETAILED DESCRIPTION OF THE INVENTION

Figure 1:
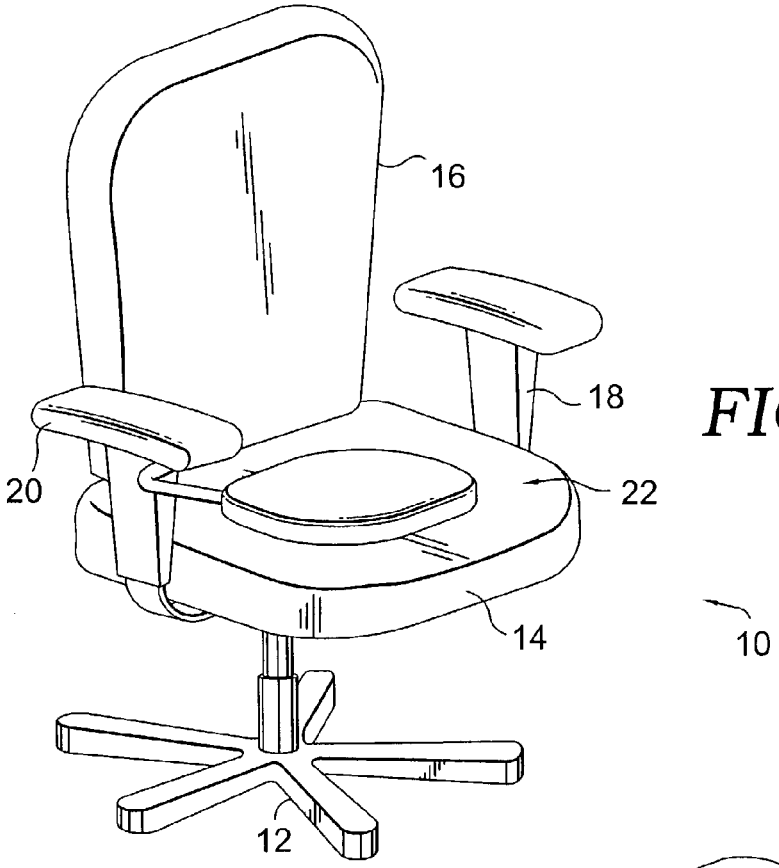
FIG. 1 is a perspective view of a chair according to the present invention with the tray assembly in the working horizontal position.

Referring to the drawings in greater detail and initially to FIG. 1, a chair with a retractable work surface is shown and is designated generally by the numeral 10. Chair 10 includes a support 12, a seat 14, and a back support 16. A pair of arms 18 extend upwardly from seat 14 and are covered with a housing 20. As would be understood by those of skill in the art, the construction of these basic components of chair 10 can vary widely. For example, the support 12 may have a number of casters to provide mobility. These construction details do not affect the scope of the present invention, as the invention is useful on chairs of various constructions and designs.

Figure 5:
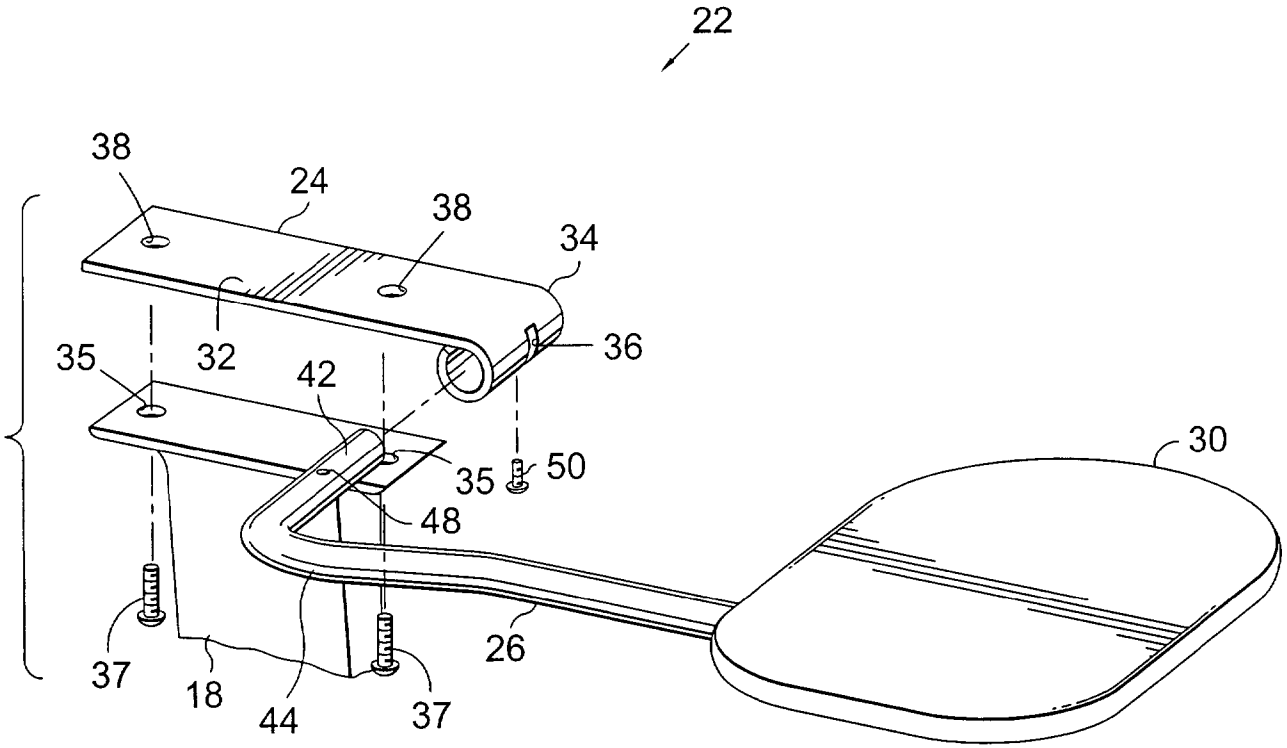
FIG. 5 is an exploded, perspective view of selected components of the tray assembly.
Figure 6:
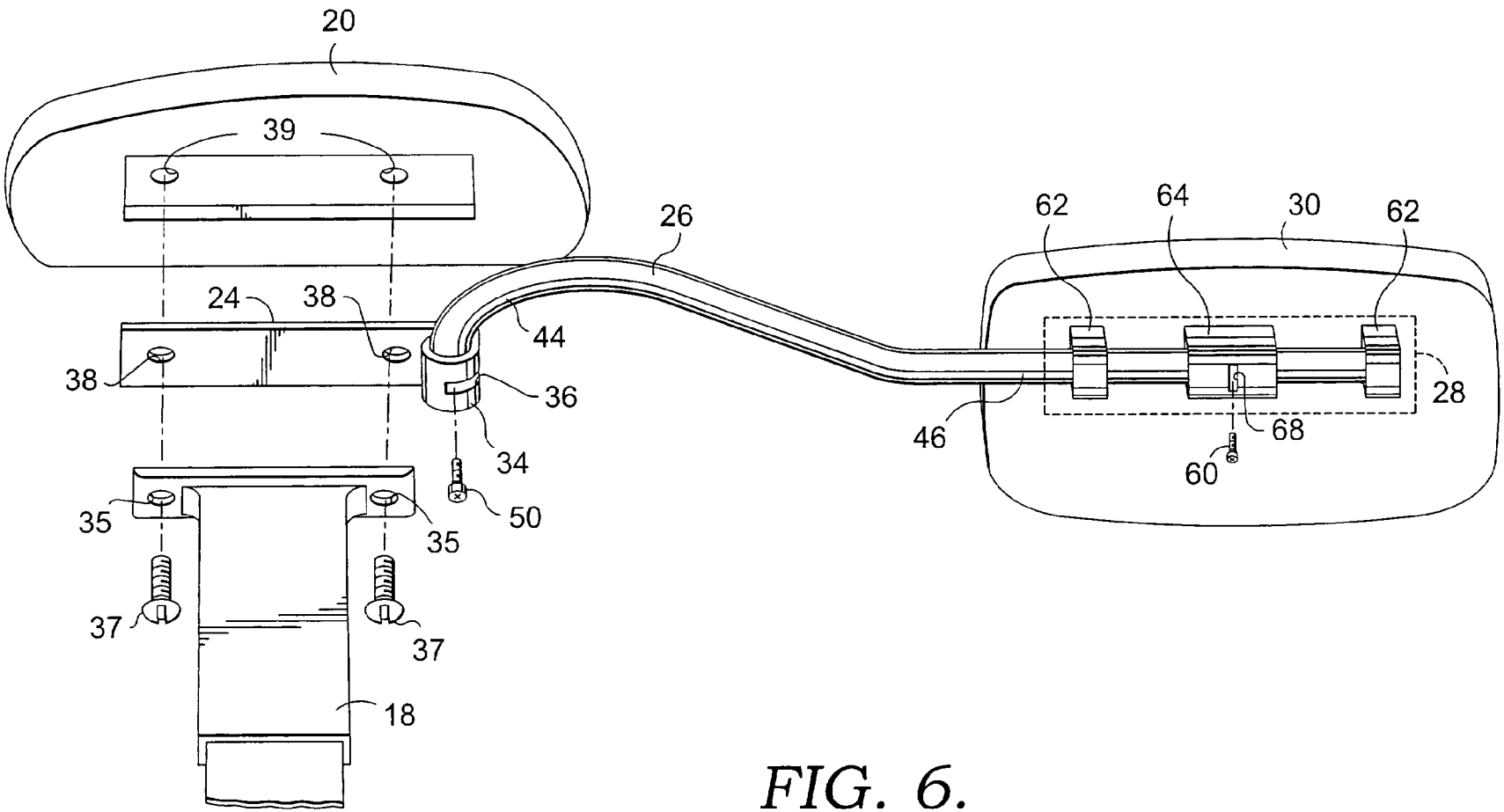
FIG. 6 is an exploded, perspective view of selected components of the tray assembly.

One of the arms 18 is equipped with an arm assembly 22 that is coupled between arm 18 and housing 20. As best seen in FIGS. 5 and 6, assembly 22 includes a collared plate 24, a rod 26, a receiving collar section 28, and a tray 30. Collared plate 24, as seen in FIG. 5, is generally rectangular in nature with a flat plate portion 32 and a cylindrical collar portion 34. Collar 34 abuts an end of plate 32. Plate 32 and collar 34 can be integral or formed from two pieces and attached by welding or any other suitable method. Collared plate 24 may be formed from stamped steel, aluminum or any other suitable material having similar characteristics. Collar 34 has a channel 36 through a defined portion of its diameter, the importance of which is described more fully below. The plate portion 32 has holes 38 defined therein suitable for attachment to arm 18. More specifically, arm 18 has a pair of holes 35 formed therein. Plate 24 is located on arm 18 such that holes 38 are in alignment with holes 35. Bolts 37 are thereafter placed through holes 35 and 38 to couple plate 24 between arm 18 and housing 20. Housing 20 has threaded holes 39 formed therein in alignment with holes 35 and 38 for receipt of bolts 37.

Rod 26 is held within collar 34 and is generally L-shaped and cylindrical in nature. Rod 26 consists of a mounting leg 42, a bend 44, and a tray leg 46. Bend 44 is generally at a right angle. As would be understood, other degrees of bend other than those shown are also suitable, depending on the desired working location for tray 30. Mounting leg 42 has a tapped hole 48 for receipt of a screw 50. Leg 42 is placed within collar 34, with the tapped hole in leg 42 in alignment with channel 36. Screw 50 is placed through channel 36 and is threaded into the tapped hole in leg 42. Tray leg 46 has a tapped hole 54 located near the outer end. Hole 54 is used to rotatably couple receiving collar section 28 and tray 30 to rod 26, as more fully described below. As best seen in FIG. 6, receiving collar section 28 includes a pair of collars 62 and a grooved stop block 64. Collars 62 are separated by and spaced apart from grooved stop block 64 along axis of rod 26. Collars 62 and grooved stop block 64 may be integrally formed with tray 30 or fixably coupled to tray 30 by any suitable method of attachment. Grooved stop block 64 has a channel 68 used to couple tray 30 to the rod 26. As best seen in FIGS. 5 and 6, channel 68 extends from approximately the lowest point of grooved stop block 64 radially for ninety degrees.

In the right-hand position shown in FIG. 6, receiving collar section 28 is attached to rod 26 by placing a fastener 60 through channel 68 into a corresponding threaded hole in rod 26. This attachment, along with the length of channel 68, allows tray 30 to be rotated from a stowed position to a working position. The fastener 60 holds the tray 30 in the working position.

Figure 3:
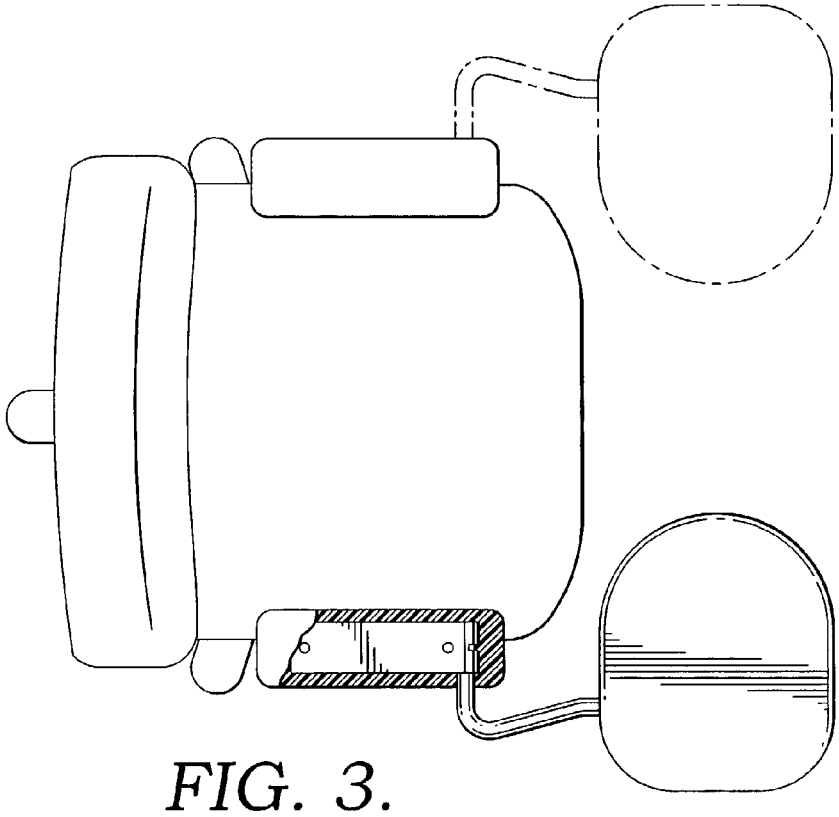
FIG. 3 is a top plan view showing the tray assembly in the right hand positions in solid lines and in the left hand position in phantom lines, with parts broken away to show details of construction.
Figure 4:
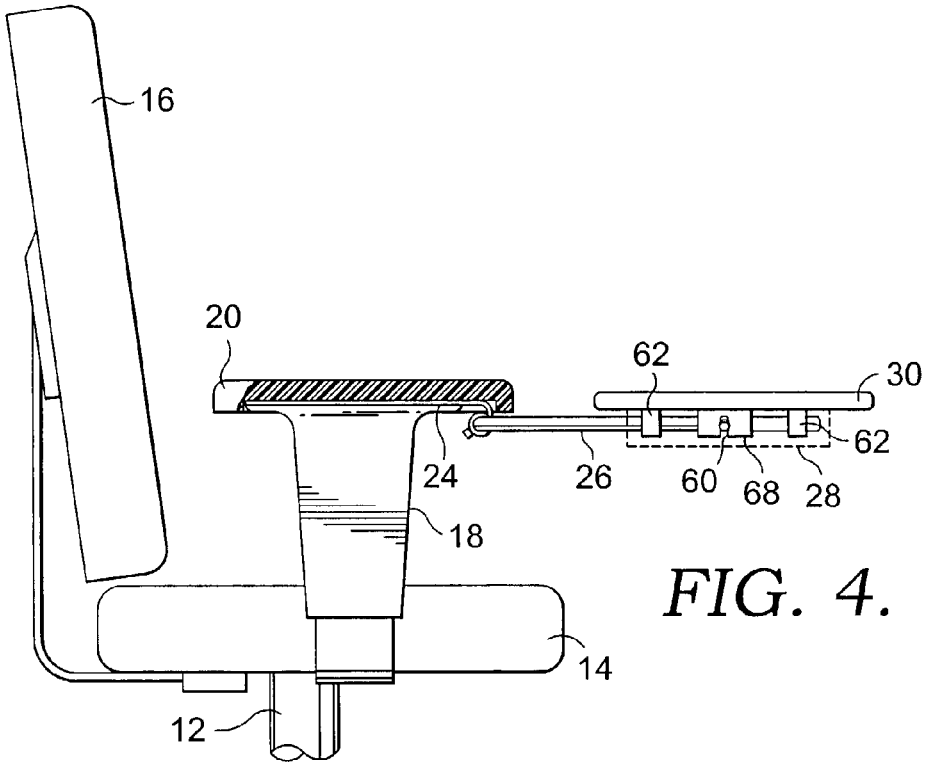
FIG. 4 is a side elevation view, with parts broken away to show details of construction.

In the left-hand position shown in FIGS. 3 and 4, receiving collar section 28 is attached to rod 26 by placing a fastener 60 through channel 68 and into the hole in rod 26. This attachment and the length of channel 68 allows the tray 30 to be rotated ninety degrees between the working position shown and the vertical stowed position. Thus, channel 68 and fastener 60 serve to maintain tray 30 in both vertical, forward position and working, horizontal, forward position, shown in FIG. 1, by allowing a limited rotation of ninety degrees.

Again, tray 30 is preferably integral with receiving collar section 28. However, tray 30 may also be fixably coupled to receiving collar section 28 by any well known means of attachment. Tray 30 is shaped and sized to allow for a usable work surface. As would be understood, shapes and sizes other than those shown and suitable for desired use are included as well.

Figure 2:
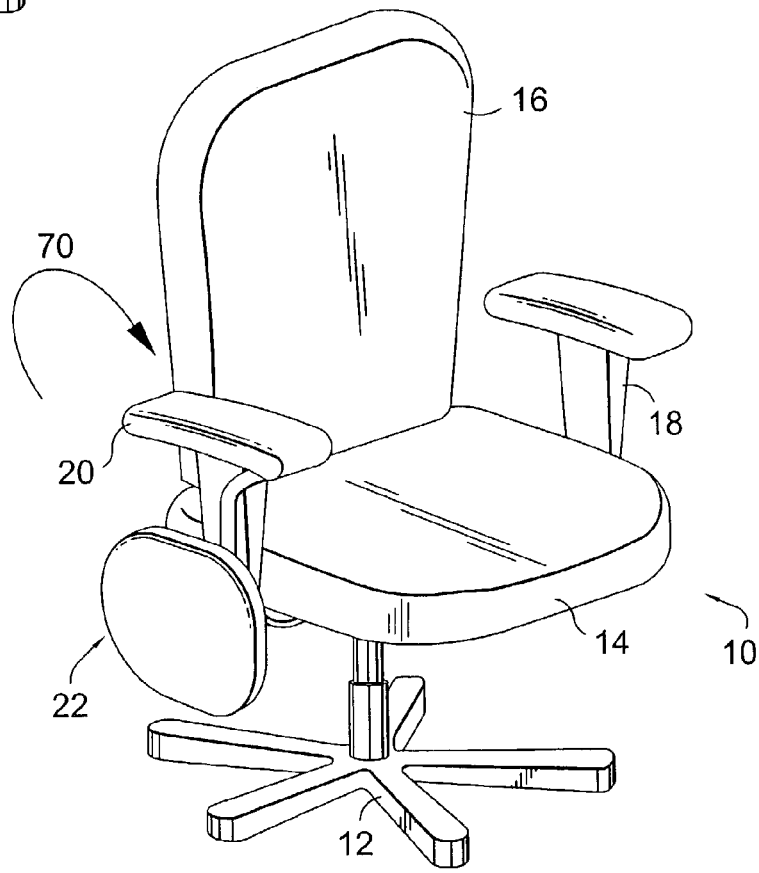
FIG. 2 is a perspective view of a chair according to the present invention with the tray assembly in the stowed vertical position.

In operation, a user is seated on seat 14. Arm assembly 22 is initially in its vertical, stowed position as seen in FIG. 2. The user grasps tray 30 and rotates rod 26 upwardly and rearwardly, as represented by arrow 70 in FIG. 2. This rotation is achieved by mounting leg 42 of rod 26 moving within collar 34. Rotation ceases when screw 50 contacts the lowermost portion of channel 36. In this position tray assembly 22 is oriented in a forward position. The user then rotates tray 30 about rod 26 until the tray is in a horizontal working position as shown in FIG. 1. Tray 30 and receiving collar section 28 rotate about leg 46 of rod 26, and stop when fastener 60 reaches the upper end of channel 68.

The above-description illustrates the use of the present invention on the right side of a chair. However as seen in FIGS. 3 and 4, the present invention can be easily converted for left hand use. As seen in FIGS. 5 and 6, the user must first remove housing 20 from arm 18. The housing 20 is removed by removing bolts 37 which secure plate 24 between arm 18 and housing 20. Housing 20 must be removed from both right and left arms 18. Arm assembly 22 is now free from chair 10. Fastener 60 is then removed from the tapped hole in rod 26 and screw 50 is removed from hole 48. Rod 26 is removed from plate 24 and from receiving collar section 28 and tray 30. Next, plate 24 is secured between housing 20 and left arm 18 of chair 10 using bolts 37. Rod 26 is inverted 180 degrees and reinserted into plate 24. Screw 50 is reinserted into hole 48 in mounting leg 42. Next, tray 30 and receiving collar section 28 are rotated 180 degrees horizontally, and tray leg 46 is reinserted in receiving collar section 28. Fastener 60 is then placed through channel 68 and into the threaded hole.

The arm assembly 22 is preferably manufactured as an original, integral component of chair 10. However, existing chairs can be adapted and retrofitted with an arm assembly 22. The collared plate 24 can easily be retrofitted or modified to accompany virtually any size or type of arm 18. For example, the device may be retrofitted to an existing chair by modifying collared plate 24 in a manner that makes it easy to mate with an arm of an existing chair. This can be accomplished by providing a number of slots, holes or grooves, thus allowing collared plate to be easily attached to the arm of an existing chair. Arm assembly 22 can then be retrofitted by rigidly attaching the arm assembly 22 to the existing arm of the chair by bolts, screws, brackets, or any other mechanical means well-known in the art.

It will be seen from the foregoing that this invention is one well-adapted to attain the ends and objects set forth above, and to attain other advantages which are obvious and inherent in the device. It will be understood that certain features and subcombinations are of utility and may be employed without reference to other features and subcombinations. This is contemplated by and within the scope of the claims. It will be appreciated by persons skilled in the art that the present invention is not limited to what has been particularly shown and described hereinabove. Rather, all matter herein set forth or shown in the accompanying drawings is to be interpreted as illustrative and not limiting.

What is claimed is:

1. A retractable work surface for a chair having a pair of arms, comprising:

a removable plate adapted to be coupled to a selected one of the chair arms, the removable plate having an end with a cylindrical collar, said cylindrical collar having a first end and a second end;

a rod having first and second ends, the first end of the rod rotatably coupled to said cylindrical collar of said plate, wherein in a first configuration the first end of the rod is placed within said first end of said collar to extend toward said second end of said collar and wherein in a second configuration said first end of said rod is placed within said second end of said collar to extend toward said first end of said collar;

a plurality of collars rotatably coupled to the second end of the rod; and a tray fixedly coupled to the plurality of collars for rotation therewith, wherein said work surface is adapted for easy conversion from said first configuration to said second configuration via said tray being fully rotatably mounted about said second end of the rod and by moving the plate, rod, the plurality of collars, and tray from the selected arm of the chair to the other arm of the chair.

2. The work surface of claim 1, wherein the plurality of collars are integral with the tray.

3. The work surface of claim 2, wherein the plurality of collars are spaced along the axis of the rod.

4. The work surface of claim 3, wherein at least one of the plurality of collars has a groove defined therein that couples the tray to the rod, the groove being of a length allowing ninety degrees of rotation of the tray with respect to the rod.

5. The work surface of claim 4, wherein the rod is generally L-shaped with the first end shorter than the second end and wherein the rod is rotated one-hundred and eighty degrees between said first configuration and said second configuration.

6. The work surface of claim 5, wherein said first configuration is for right-handed use.

7. The work surface of claim 6, wherein said second configuration is for left-handed use.

8. The work surface of claim 5, wherein the tray is movable between a stowed, vertical position to a working, horizontal position through rotation of the rod within the collar to a position with the second end of the rod in a horizontal orientation followed by a rotation of the tray and bracket about the second end of the rod until the tray is in the horizontal orientation.

9. The work surface of claim 8, wherein the grooved collar has a slot therein corresponding in location to a threaded hole in the first end of the rod, further comprising an attachment mechanism placed through the slot and into the threaded hole, the slot defining the range of motion of the rod.

10. The work surface of claim 9, wherein the arm of the chair has a housing generally covering the arm, and wherein the plate is disposed between the arm and the housing.

11. A chair having a pair of arms and a retractable work surface, comprising:

a plate having a forward collar, the plate removably coupled to a selected one of the arms, said collar having a first end and a second end;

a rod having first and second ends, the first end rotatably coupled within the collar of the plate, wherein in a first configuration the first end of the rod is placed within said first end of said collar to extend toward said second end of said collar and wherein in a second configuration said first end of said rod is placed within said second end of said collar to extend toward said first end of said collar;

at least one receiving collar having a grooved stop system; and a tray fixedly coupled with the at least one receiving collar, the tray and the at least one receiving collar being rotatably coupled about the second end of the rod, the grooved stop system defining the range of motion of the tray with respect to the rod where said tray is either in said first or second configuration; said tray being fully rotatably mounted about said second end of said rod when converting said first and second configurations.

12. The chair of claim 11, wherein the rod is generally L-shaped, with the first end shorter in length than the second end.

13. The chair of claim 12, further comprising a housing arm rest on each arm of the chair, and wherein the plate is disposed between the housing and the arm so that the plate is substantially out of sight.

14. The chair of claim 13, wherein the collar has a groove defining rotation of the first end of the rod to two-hundred and seventy degrees.

15. The chair of claim 14, wherein the second end of the rod is substantially vertical when the tray is in a stowed position and wherein the second end of the rod is substantially horizontal when the tray is in use in an extended position, the collar groove defining the stowed and extended positions of the rod.

* * * * *